US009108710B1

(12) United States Patent
McChesney et al.

(10) Patent No.: US 9,108,710 B1
(45) Date of Patent: Aug. 18, 2015

(54) PONTOON BOAT

(71) Applicant: BRP US INC., Sturtevant, WI (US)

(72) Inventors: Richard McChesney, Waukegan, IL (US); George Broughton, Wadsworth, IL (US); Nicolas Schmidt, Racine, WI (US)

(73) Assignee: BRP US INC., Sturtevant, WI (US)

( * ) Notice: Subject to any disclaimer, the term of this patent is extended or adjusted under 35 U.S.C. 154(b) by 0 days.

(21) Appl. No.: 14/168,479

(22) Filed: Jan. 30, 2014

Related U.S. Application Data

(60) Provisional application No. 61/759,038, filed on Jan. 31, 2013.

(51) Int. Cl.
*B63B 1/00* (2006.01)
*B63H 5/07* (2006.01)
*B63B 35/34* (2006.01)

(52) U.S. Cl.
CPC . *B63H 5/07* (2013.01); *B63B 35/34* (2013.01)

(58) Field of Classification Search
CPC ..... B63B 35/34; B63B 35/38; B63H 5/07; B63H 5/125; B63H 5/16
USPC ..... 114/61.1, 288, 292; 440/53, 61 T, 68, 69
See application file for complete search history.

(56) References Cited

U.S. PATENT DOCUMENTS 2,698,447 A * 1/1955 Potts et al. ..... 114/345
3,646,905 A * 3/1972 Martinmaas ..... 114/55.54
3,812,814 A * 5/1974 Veilleux ..... 114/55.57
3,815,541 A 6/1974 Hansen
4,014,283 A 3/1977 Crnogorac
4,021,873 A 5/1977 Francois
4,040,378 A 8/1977 Blanchard
4,236,478 A 12/1980 Mansson
4,543,069 A 9/1985 Kobayashi
4,652,245 A 3/1987 May
5,108,325 A 4/1992 Livingston et al.
5,203,271 A 4/1993 Chapman
5,833,502 A 11/1998 Anderson (Continued)

FOREIGN PATENT DOCUMENTS

JP 2002019699 A 1/2002
WO 2010116576 A1 10/2010

OTHER PUBLICATIONS

English Abstract of JP2002019699 Published Jan. 23, 2002, Retrieved from http://worldwide.espacenet.com on Jan. 29, 2014.

*Primary Examiner* — Daniel V Venne
(74) *Attorney, Agent, or Firm* — BCF LLP

(57) ABSTRACT

A pontoon boat has left and right pontoons extending longitudinally, a tunnel therebetween, and a deck supported thereon. Bow and stern ends, and a boat length therebetween, are defined by at least one of the pontoons and the deck. An opening of the deck communicating with a tunnel thereunder has an outboard engine mounted therein and a hatch disposed thereover. A longitudinal center plane is vertical and equidistant from the bow and stern ends. A drive unit of the engine has a driveshaft, a propeller shaft operatively connected thereto, and a propeller connected to the propeller shaft. A mounting bracket connects the drive unit to the deck. The engine is disposed forward of the stern end by a distance at least equal to one-fourth of the boat length. The engine is aligned with or rearward of a longitudinal center plane. A method of operating the pontoon boat is also disclosed.

18 Claims, 5 Drawing Sheets

(56) References Cited

U.S. PATENT DOCUMENTS

| | | | |
|---|---|---|---|
| 6,425,364 | B1 | 7/2002 | Craft et al. |
| 6,497,594 | B1 | 12/2002 | Towner et al. |
| 6,790,108 | B1 | 9/2004 | Schiebout |
| 7,004,092 | B2 | 2/2006 | Yetter et al. |
| 7,185,599 | B1 | 3/2007 | Griffiths et al. |
| 7,263,940 | B2 | 9/2007 | Yetter et al. |
| D556,668 | S | 12/2007 | Quinn |
| 7,533,622 | B1 | 5/2009 | Jaszewski et al. |
| 7,753,747 | B1 | 7/2010 | Jones et al. |

* cited by examiner

PONTOON BOAT

CROSS-REFERENCE

The present application claims priority to U.S. Provisional Patent Application No. 61/759,038 filed on Jan. 31, 2013, the entirety of which is incorporated herein by reference.

FIELD OF THE INVENTION

The present invention relates generally to pontoon boats.

BACKGROUND

Pontoon boats, which typically range in length from 5-10 m (15-30 feet), are usually powered by one or more outboard engines mounted to a transom of the pontoon boat and therefore necessitate a barrier to prevent passengers from inadvertently getting too close to the outboard engine while it is in operation. Typically, the barrier is formed by a guardrail, a wall, a storage locker or a front facing-bench extending across at least a majority of the rear portion of the deck. With the driver stationed near the longitudinal center of the pontoon, typically along the starboard side, this rear barrier can block the driver's rearward line of sight. This is not a desirable configuration when the area surrounding the boat, especially behind the boat, is populated with people participating in water activities, such as swimming, skiing and the like. This configuration of a conventional pontoon boat is also inconvenient for a spotter when a water skier, wake-boarder, inflatable raft, and the like is being towed by the boat as the spotter has to hang over the transom in order to have adequate view of the towed object/persons.

This problem has sometimes been addressed by using an inboard/outboard motor (I/O motor), also referred to as a stern drive, mounted inside the vessel and not to the transom. In this arrangement, the propeller is positioned beneath the deck, a swim platform or the like, reducing the likelihood of accidental contact with the propeller. I/O motors are however heavier and relatively more complex to install compared to outboard engines as they require a watertight bilge area for housing the I/O motor.

There is a need for a pontoon boat powered by an outboard engine and having a configuration wherein the outboard engine is easily accessible for maintenance and installation without blocking visibility of the driver, and the propeller is located so as not to hamper the normal activities of people in the vicinity of the boat.

SUMMARY

It is an object of the present invention to ameliorate at least some of the inconveniences present in the prior art.

In one aspect, the present provides a pontoon boat having a left pontoon and a right pontoon. The left and right pontoons extend longitudinally. A central axis of the left pontoon is parallel to a central axis of the right pontoon. A longitudinal centerline is disposed in a plane containing the central axes of the left and right pontoons. The longitudinal centerline is equidistant from each of the central axes of the left and right pontoons. A deck is supported by the left and right pontoons. A tunnel extends longitudinally between the left and right pontoons below the deck. A bow end is defined by at least one of the left pontoon, the right pontoon and the deck. A stern end is defined by at least one of the left pontoon, the right pontoon and the deck. A boat length is defined by a distance between the bow end and the stern end. A longitudinal center plane of the boat is defined by a vertical plane normal to the longitudinal centerline and disposed longitudinally equidistant from the bow end and the stern end. An opening is defined in the deck and communicates with the tunnel. An outboard engine is mounted in the opening. A hatch is disposed over the opening and the outboard engine. The outboard engine includes a drive unit having a driveshaft. A propeller shaft is operatively connected to the driveshaft; and a propeller is connected to the propeller. A mounting bracket connects the drive unit to the deck. The engine is disposed forward of the stern end by a distance at least equal to one-fourth of the boat length in the longitudinal direction. The engine is one of: aligned with and rearward of the center plane in the longitudinal direction.

In an additional aspect, the boat length is one of equal to and less than twenty feet, and the outboard engine is disposed at a position about the longitudinal center plane in the longitudinal direction.

In a further aspect, the boat length is greater than twenty feet, and the outboard engine is disposed at a position at least equal to one foot behind the longitudinal center plane in the longitudinal direction.

In another aspect, the driveshaft is aligned with the longitudinal centerline in the lateral direction.

In yet another aspect, a deflector is mounted in the tunnel forward of the outboard engine.

In an additional aspect, the propeller is disposed lower than the deflector when the driveshaft is disposed in a vertical orientation.

In a further aspect, the deflector is attached to the deck.

In a further aspect, the mounting bracket is connected to the deflector.

In another aspect, the drive unit is pivotable with respect to the mounting bracket about a trim axis, the trim axis being horizontal and perpendicular to the longitudinal centerline.

In yet another aspect, the drive unit is fixed with respect to the mounting bracket about a vertical axis.

In an additional aspect, at least one rudder is connected to a rear portion of at least one of: the deck, the left pontoon and the right pontoon.

In an additional aspect, the rear portion is the rear end.

In a further aspect, the at least one rudder comprises a left rudder and a right rudder.

In another aspect, the left rudder is attached to the left pontoon and the right rudder is attached to the right pontoon.

In yet another aspect, at least one lateral thruster is included. Each of the at least one lateral thruster is supported by at least one of: the deck, the left pontoon and the right pontoon. For each of the at least one lateral thruster, a central axis of the lateral thruster is generally horizontal and generally transverse to the longitudinal centerline.

In yet another aspect, the at least one lateral thruster includes a left lateral thruster mounted to the left pontoon and a right lateral thruster mounted to the right pontoon.

In an additional aspect, the left lateral thruster is connected to a forward portion of the left pontoon, and the right lateral thruster is connected to a forward portion of the right pontoon.

In another aspect, the bow end is defined by the left pontoon and the right pontoon. The stern end is defined by the left pontoon and the right pontoon. The boat length defined by the distance between the bow end and the stern end is defined by the left pontoon and the right pontoon.

In another aspect, the present provides a method of operating a pontoon boat in water. The pontoon boat has a bow end and a stern end, at least two pontoons extending longitudinally beneath a deck, an outboard engine mounted to the deck along a longitudinal centerline of the pontoon at a position rearward of the bow end by a distance between half and three-fourths of the distance from the bow end to the stern end. The outboard engine includes a drive unit pivotally connected to a mounting bracket disposed forward of the drive unit. The drive unit is pivotable about a trim axis. The method includes hydrodynamically lifting the bow end of the pontoon boat by pivoting the drive unit towards the mounting bracket about the trim axis.

For purposes of the present application, terms related to spatial orientation when referring to a pontoon boat and components in relation to the pontoon boat, such as "forwardly", "rearwardly", "left", "right", "above" and "below", are as they would be understood by a driver of the pontoon boat, with the pontoon boat in a straight ahead orientation (i.e. not steered left or right), and in an upright position (i.e. not tilted). The explanations provided above regarding the above terms take precedence over explanations of these terms that may be found in the document incorporated herein by reference.

Embodiments of the present invention each have at least one of the above-mentioned object and/or aspects, but do not necessarily have all of them. It should be understood that some aspects of the present invention that have resulted from attempting to attain the above-mentioned object may not satisfy this object and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION

Figure 1:
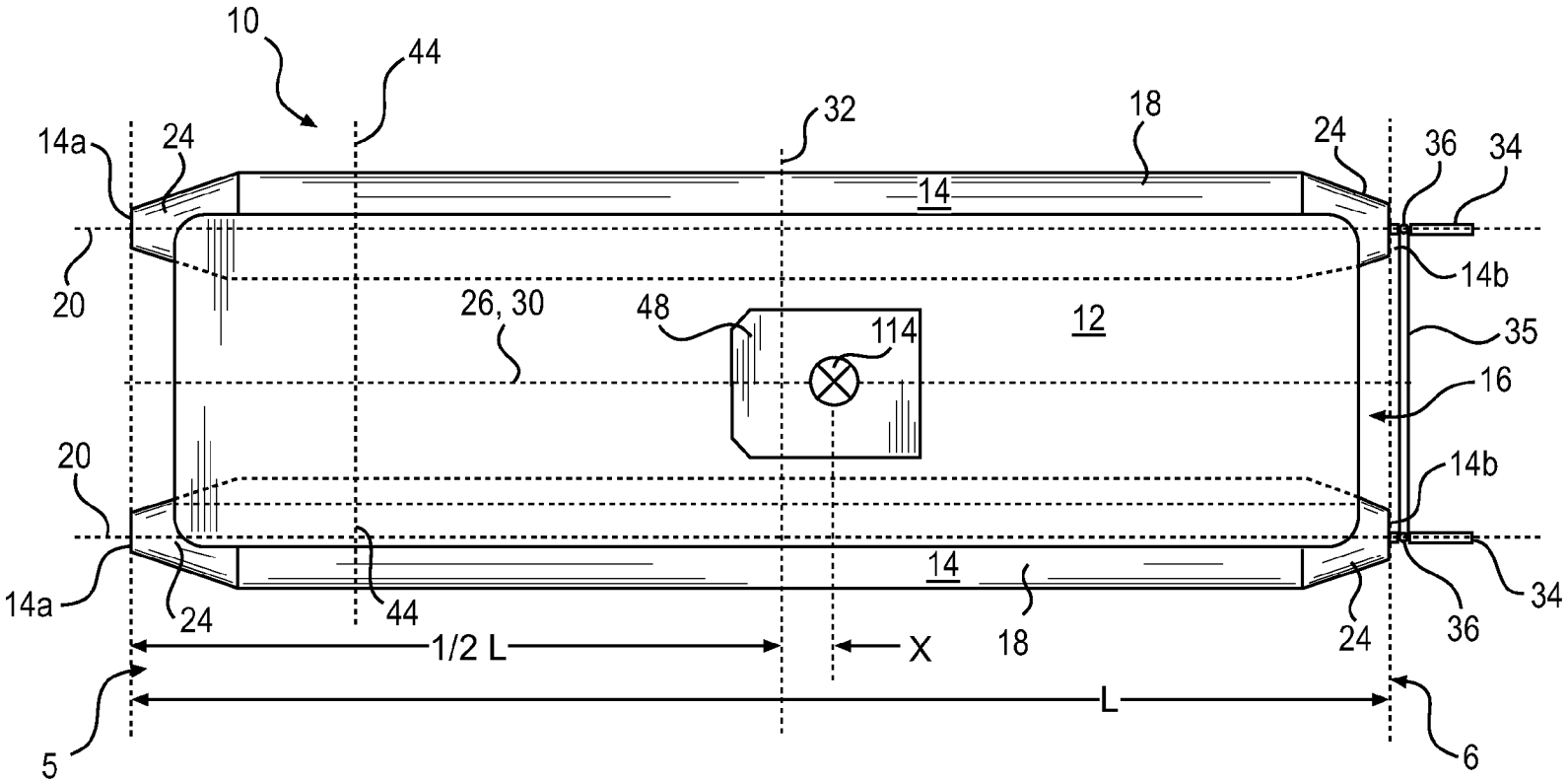
FIG. 1 is a schematic top plan view of a pontoon boat with all components normally positioned on the deck, except for a hatch, removed for clarity.
Figure 2:
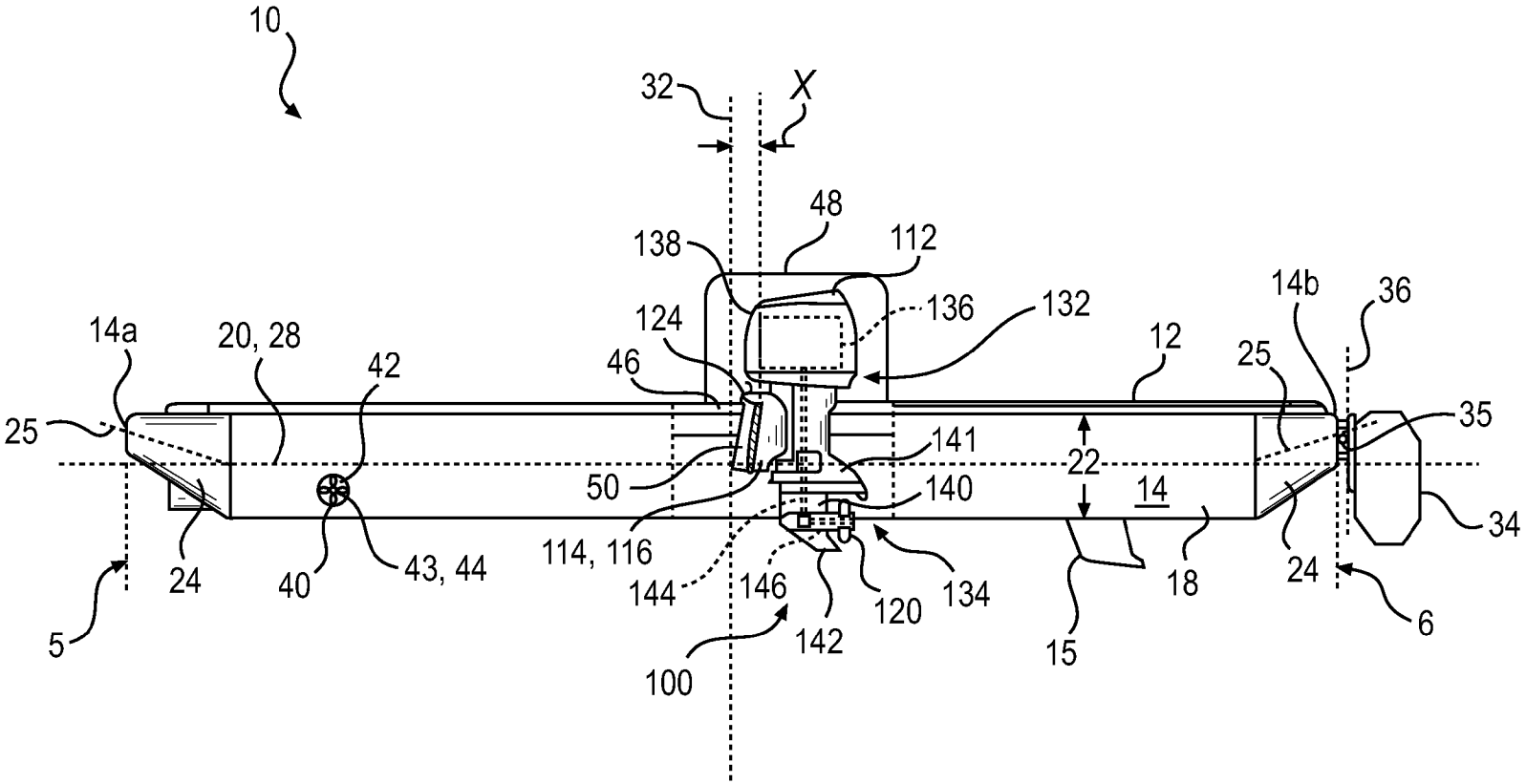
FIG. 2 is a schematic partially cut-away left side elevation view of the pontoon boat of FIG. 1, showing an outboard engine mounted thereto.

With reference to FIGS. 1 and 2, the pontoon boat 10 includes a deck or a platform 12 supported on a left pontoon 14 and a right pontoon 14. The left pontoon 14 and the right pontoon 14 are bolted to the undersurface of the deck 12. A tunnel 16 is defined by the space between the pontoons 14 below the deck 12. It is also contemplated that the pontoon boat 10 could be constructed of more than two pontoons 14 which could form a single tunnel 16, or multiple tunnels 16.

The pontoons 14 are elongated tubular structures. The pontoons 14 are hollow and watertight so as to provide buoyancy. It is contemplated that the pontoon 14 could be filled with a low density material such as foam, for example. The left pontoon 14 is identical to the right pontoon 14, and as such only the right pontoon 14 will be described herein. It is contemplated that the pontoons 14 could be mirror images of each other, or different from each other. The pontoon 14 has a front end 14*a* and a rear end 14*b*. The pontoon 14 has a central cylindrical portion 18 with a diameter 22 and a central cylindrical axis 20. The cylindrical portion 18 of the pontoon 14 ends in a conical frustum 24 at the front and rear ends. A central axis 25 of the front end conical frustum 24 extends forward and upward with respect to the central axis 20 of the cylindrical portion. A central axis 25 of the conical frustum 24 of the rear end extends rearward and upward with respect to the central axis 20 of the cylindrical portion 18. The upper surfaces of the front conical frustum 24, the cylindrical portion 18, and the rear conical frustum 24 are disposed so that the pontoon 14 has a horizontal and continuous upper surface across the entire length thereof. A skeg 15 extends downward from the lower surface of the cylindrical portion 18 near the rear end 14*b* of the pontoon 14. It is contemplated that the pontoons 14 could have a different configuration than as described above.

A bow end 5 of the boat 10 is defined by the front ends 14*a* of the left and right pontoons 14. A stern end 6 of the boat 10 is defined by the rear ends 14*b* of the left and right pontoons 14. The distance between the bow end 5 and the stern end 6 defines the length L of the boat 10. It is also contemplated that the boat 10 could have a central pontoon between the left and right pontoons 14, and that a front end of the central pontoon could extend forward of the front end 14*a* of the pontoons 14, or that a rear end of the central pontoon could extend further rearward than the rear end 14*b* of the pontoons 14. For a boat 10 having such a central pontoon between the left and right pontoons 14, the boat length L would still be defined by the length of the pontoons 14 between their front and rear ends. In the illustrated embodiment, the front and rear ends 14*a*, 14*b* of the pontoons 14 extend beyond the deck 12. It is contemplated that the deck 12 could be longer than the pontoons 14, and bow and stern end 5, 6 and therefore the length of the boat 10 could be defined with respect to the deck 12 instead of the pontoons 14.

The central cylindrical axes 20 of the left and right pontoons 14 are spaced apart by a distance larger than the diameter 22 of the cylindrical portion 18 so the tunnel 16 between the inward facing surfaces of the pontoons 14 has a width approximately twice the diameter 22 of the cylindrical portion. It is contemplated that the relative widths of the pontoons 14 and the tunnel 16 could be different than in the illustrated embodiment.

A longitudinal centerline 26 is defined equidistant from the axes 20 in a horizontal plane 28 (FIG. 2) containing the axes 20. A vertical plane 30 (FIG. 1) containing the longitudinal centerline 26, and therefore positioned at the lateral center of the pontoon boat 10, forms the lateral center plane 30 of the pontoon boat 10. A vertical plane 32 normal to the longitudinal centerline 26 and equidistant from the bow end 5 and the stern end 6 defines a longitudinal center plane 32 of the boat 10.

A rudder 34 is pivotably attached to the rear end of each pontoon 14 for steering the boat 10. Each rudder 34 is pivotable about a respective vertical axis 36. Each rudder 34 is mounted so that the vertical axis 36 intersects the central cylindrical axis 20 of the pontoon 14. The rudders 34 are operatively connected to a steering mechanism (not shown) at the helm (not shown). In the illustrated embodiment, the steering mechanism is a power steering mechanism in which a hydraulic linear actuator (not shown) is connected to one of the rudders 34, and the two rudders 34 are connected to each other by a tie-rod 35. Thus, the linear actuator directly controls one of the rudders 34 which moves the other rudder 34 via the tie-rod 35. It is contemplated that the two rudders 34 could be connected to each other hydraulically, by a hydraulic tie-bar or a "liquid tie bar" instead of mechanically via the tie-rod. It is also contemplated that each rudder 34 could be connected to a separate linear actuator. It is contemplated that the rudders 34 could be attached to the pontoon 14 such that the vertical axes 36 are offset from the central axes 20 of the pontoon 14. It is contemplated that each rudder 34 could be connected to a structure other than the corresponding pontoon 14, for example the rudders 34 could be attached to the deck 12 between the pontoons 14. It is also contemplated that the pontoon boat 10 could be provided with a single central rudder 34 with the corresponding vertical axis 36 intersecting the longitudinal centerline 26 of the boat 10. It is further contemplated that the boat 10 could have more than two rudders 34.

A lateral thruster 40 is connected to the pontoon 14 in a passage 42 extending laterally through a forward portion of the pontoon 14. The lateral thruster 40 is disposed in the forward portion of the cylindrical portion 18 but it is contemplated that it could be disposed in other locations, including the front or rear conical frustum 24. The lateral thruster 40 in the illustrated embodiment includes an impeller 43 having a central axis 44. The impeller 43 provides a lateral thrust in the direction of the central axis 44 to the pontoon 14, and thereby the boat 10, when being operated. The central axis 44 of the impeller 43 is horizontal and perpendicular to the central cylindrical axis 20 of the pontoon 14. The central axis 44 of the impeller 43 is disposed below the central axis 20 of the pontoon 14. It is contemplated that the lateral thruster 40 could be positioned elsewhere along the pontoon 14. It is contemplated that additional lateral thrusters 40 could be provided. For example, the pontoon 14 could have a fore lateral thruster 40 as shown in the figures, as well as an aft lateral thruster 40 in a rear portion of the pontoon 14. It is contemplated that propeller-type lateral thrusters mounted to the outside of the pontoons 14 or deck 12 could similarly be used. The left and/or right lateral thruster 40 is/are selectively operated for providing thrust in a lateral direction. The lateral thrusters 40 are used primarily for docking, while the rudders 34 are used primarily for steering in open waters.

An opening 46 is formed in the deck 12 and a hatch 48 is positioned over the opening 46. The lateral center plane 30 and the longitudinal center plane 32 pass through the opening 46. The opening 46 is substantially rectangular but it is contemplated that the opening 46 could have a different shape. The opening 46 of the deck 12 communicates with the tunnel 16.

The helm (not shown), from where the operation of the boat 10 is controlled, is positioned immediately behind the hatch 48. It is contemplated that the helm could be positioned on a right side of the hatch 48, or on a left side thereof. A driver's seat may also be provided behind the helm. A passenger seating area could be provided forward and/or rearward of the hatch 48. A reboarding platform (not shown) is provided at the rear end of the deck 12. It is contemplated that the reboarding platform could be pivotable to form a tailgate that swivels between an up (close) and down (open) position. The deck 12 supports other structures such as railings, seats, and the like, which have been omitted from FIGS. 1 and 2 out of clarity, and will not be described herein.

With reference to FIG. 2, an outboard engine 100 is mounted in the opening 46 of the deck 12. An engine mount 50, extending from the deck 12 into the tunnel 16, supports the outboard engine 100. The engine mount 50 is welded or otherwise fixed to the deck 12 at the edge of the opening 46. The engine mount 50 is in the form of a rectangular bracket. The engine mount 50 is slightly tilted from the vertical so that its lower end in the tunnel 16 is disposed slightly forward with respect to its upper end which is connected to the deck 12. It is contemplated that the engine mount 50 could be constructed differently, or that the engine mount 50 could not be tilted with respect to the vertical direction.

The outboard engine 100 of the present embodiment is a conventional outboard engine, i.e. one that would typically be mounted to the stern end of the hull of a conventional watercraft having a transom. The outboard engine 100 includes a drive unit 112 and a bracket assembly 114. The bracket assembly 114 connects the drive unit 112 to the engine mount 50. The engine mount 50 is configured to be similar to the transom so that a stern-mounted outboard engine can be used without significant alterations to the bracket assembly 114. U.S. Pat. No. 7,736,206, issued on Jun. 15, 2010 to McChesney et al., the entirety of which is incorporated herein by reference, provides additional details related to stern-mounted outboard engines. Other types of bracket assemblies are similarly applicable.

The drive unit 112 includes an upper portion 132 disposed above the deck 12, and a lower portion 134 disposed below the deck 12 in the illustrated embodiment. The upper portion 132 includes an engine 136 (schematically shown in dotted lines in FIG. 2) surrounded and protected by a cowling 138. The lower portion 134 includes a gear case assembly 140, a skeg portion 142, and the midsection 141 which extends from the upper portion 132 to the gear case assembly 140. The lower portion includes the propeller 120 mounted on a propeller shaft 146. The midsection 141 includes an exhaust system (not shown) that routes exhaust gases out through the propeller 120 and through an idle exhaust relief outlet (not shown) along the rear side of the lower portion 134, as is known in the art. An idle exhaust conduit 150 (FIG. 3) is connected to the idle exhaust relief outlet and extends rearward therefrom so as to route exhaust gases above the surface of the water away from the opening 46 when the outboard engine 100 is in idle operation. It is contemplated that the idle exhaust system could also be provided with a blower for directing the exhaust gases during idle operation.

The engine 136, housed within the cowling 138, is an internal combustion engine, such as a two-stroke or four-stroke engine, having cylinders extending horizontally. It is contemplated that other types of engines could be used and that the cylinders could be oriented differently. The engine 136 is coupled to a driveshaft 144 (schematically shown in dotted lines in FIG. 1). When the drive unit 112 is in the upright position as shown in FIG. 2, the driveshaft 144 is oriented vertically. It is contemplated that the driveshaft 144 could be oriented differently relative to the engine 136. The driveshaft 144 is coupled to a drive mechanism (not shown), including a transmission 148 (shown schematically in dotted lines) and the propeller shaft 146. The driveshaft 144 and the drive mechanism transfer the power from the engine 136 to the propeller 120 mounted on the rear side of the gear case assembly 140 of the drive unit 112. In FIG. 2, the propeller shaft 146 is shown perpendicular to the driveshaft 44, however it is contemplated that it could be at other angles.

Other known components of an engine assembly are included within the cowling 38, such as a starter motor, an alternator and the like. As it is believed that these components would be readily recognized by one of ordinary skill in the art, further explanation and description of these components will not be provided herein.

The bracket assembly 114 includes a mounting bracket 116 pivotally attached to the drive unit 112. The bracket assembly 114 could also include actuators, linear and/or rotary, for pivoting or otherwise adjusting the position of the drive unit 112 with respect to the engine mount 50. The mounting bracket 116 attaches the drive unit 112 to the engine mount 50 such that the propeller 120 of the drive unit 112 is in a submerged position with the boat 10 resting relative to a surface of a body of water. At least a portion of the propeller 120 is disposed lower than the pontoons 14. The mounting bracket 116 is similar to the stern bracket of a stern-mounted outboard engine. The engine mount 50 is configured to be similar to the transom so that a stern-mounted outboard engine can be used without significant alterations to the bracket assembly 114. The mounting bracket 116 is bolted to the engine mount 50. A series of holes 152 are provided on the mounting bracket 116 so that the vertical position of the outboard engine 100 can be adjusted with respect to the engine mount 50. It is also contemplated that the engine mount 50 could be a jack plate that, as is known in the art, allows the vertical position of the outboard engine 100 to be varied with respect to the deck 12 and/or pontoons 14.

Figure 3:
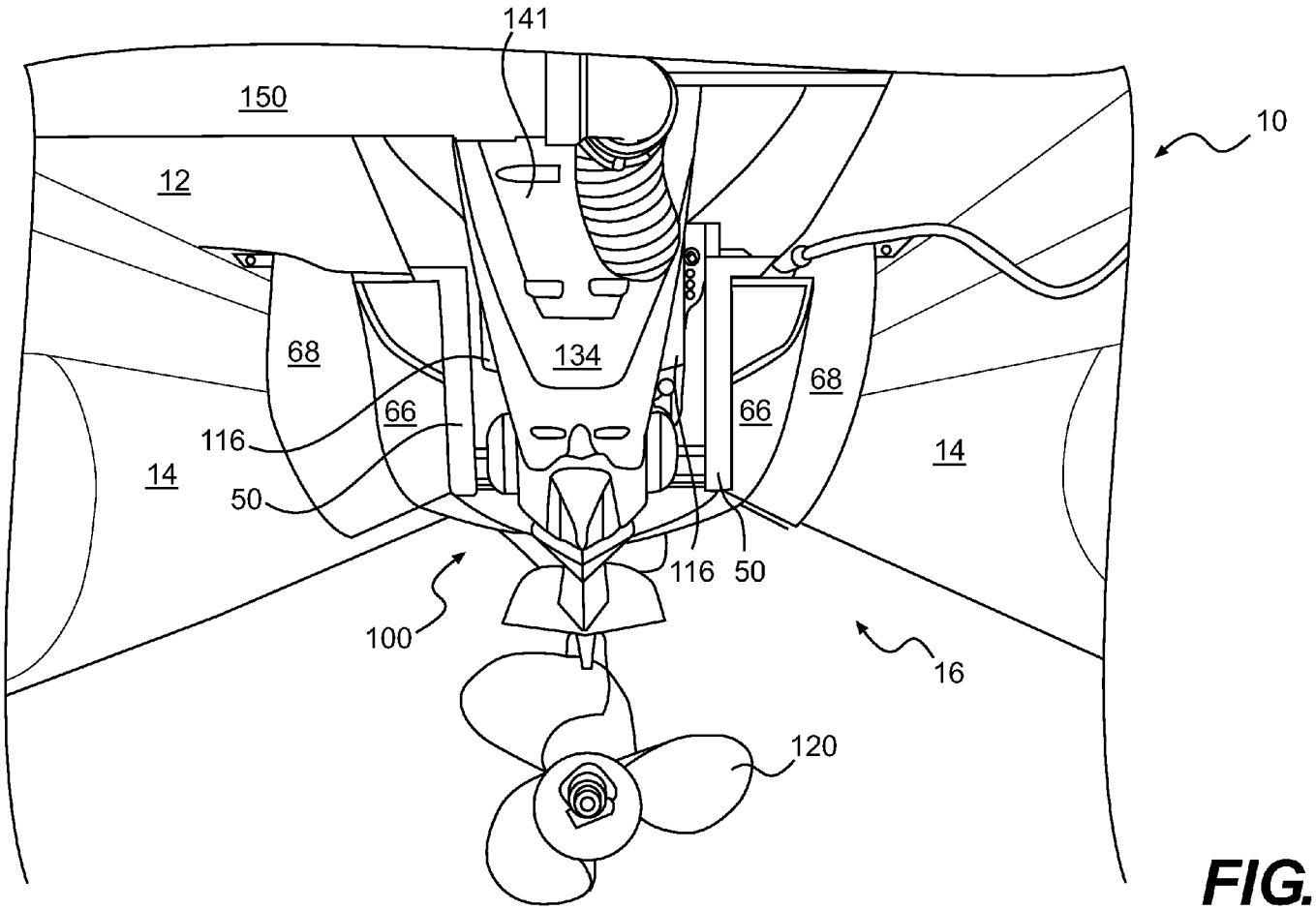
FIG. 3 is a perspective view, taken from a rear, bottom, of the pontoon boat of FIG. 1 showing the outboard engine of FIG. 2 mounted in a tunnel.
Figure 4:
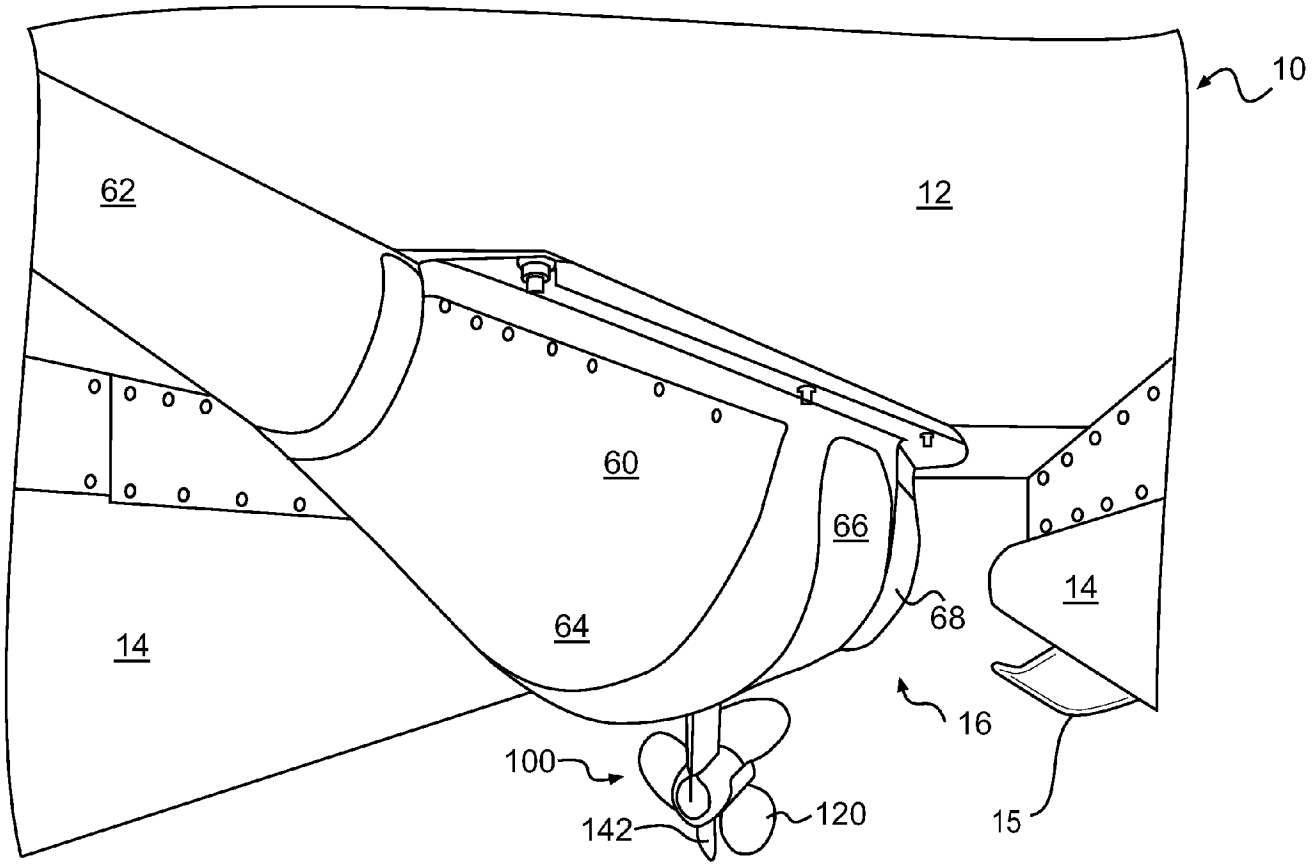
FIG. 4 is a perspective view, taken from a front, right and bottom, of the pontoon boat of FIG. 1 showing a deflector mounted in the tunnel forward of the outboard engine.
Figure 5:
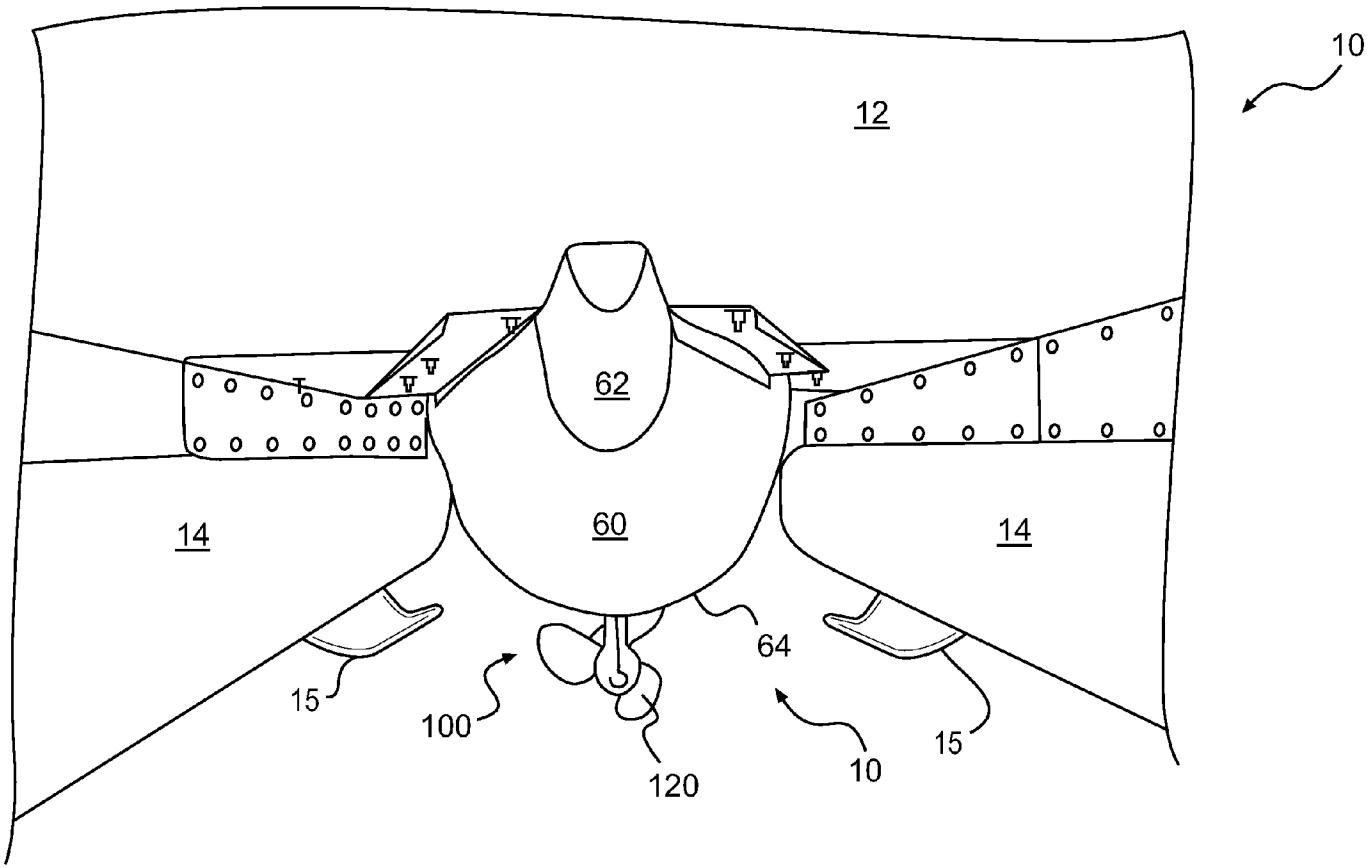
FIG. 5 is a perspective view, taken from a front, bottom, of the pontoon boat of FIG. 1 and showing the deflector mounted in the tunnel forward of the outboard engine.

With reference to FIGS. 3 to 5, a deflector 60 is disposed in the tunnel 16 forward of the outboard engine 10. The deflector 60 is bolted to the undersurface of the deck 12. It is contemplated that the deflector 60 could be fastened to the deck 12 by other means. It is also contemplated that the deflector 60 could be attached to the pontoons 14 instead of, or in addition to, being attached to the deck 12. The deflector 60 is laterally centered in the tunnel 16 and spaced from the inner surfaces of the left and right pontoons 14 so that water can flow rearward through the tunnel 16 around the sides of the deflector 60. The smoothly curved surface of the deflector 60 deflects water flowing in the tunnel 16 to either side of the lower portion 134 of the outboard engine 100, excluding the gear case assembly 140. The deflector 60 is positioned to be higher than the propeller 120 of the outboard engine 100 as can be seen in FIG. 3.

The deflector 60 is intended to minimize the drag caused the midsection 141 and as such is sized and shaped to shield as much of the lower section 134 as possible without negatively effect the thrust generated by the propeller 120. The deflector 60 is an elongated hollow structure. The deflector 60 tapers from a central portion 64 having a large cross-section towards a nose 62 in the front end 62. The rear end 66 of the deflector is positioned just forward of the engine mount 50. The narrow front end 62 has a smaller lateral and vertical dimension than the central portion 64 and the rear end 66. From the narrow front end 62, the outer surface of the deflector 60 extends rearward, laterally outward and downward towards the central portion 64. The outer surface of the deflector 60 extends rearward from the central portion 64 to the rear end 66. Fins 68 extending rearward from the rear end 66 on each side of the engine mount 50 and the mounting bracket 116 of the outboard engine 100 help to deflect water in a rearward direction along the sides of the lower portion 134. The deflector 60 encloses a closed volume within the nose 62, central portion 64 and the rear end 66, and as such is buoyant and functions like a central pontoon. It is also contemplated that another central pontoon could similarly be provided in the tunnel 16 rearward of the outboard engine 100. It is contemplated that the deflector 60 not enclose a closed volume but merely provide surfaces, such as the fins 68, to deflect the flow of water and spray around the midsection 141. For example, the central and rear portions 64, 66 could be omitted, and deflector 60 could be formed by the nose 62 with fins 68 connected thereto.

The drive unit 112 is laterally centered with respect to the boat 10 such that the lateral center plane 30 passes through the driveshaft 144 (as can be seen by the position of the driveshaft 144 indicated in FIG. 1). It is contemplated that the outboard engine 100 could not be laterally centered and the lateral center plane 30 could not pass through the driveshaft 144. The driveshaft 144 is disposed rearward of the longitudinal center plane 32 as can be seen in FIG. 2. The propeller shaft 146 is parallel to the longitudinal centerline 26 when the drive unit 112 is in an upright position as shown in FIG. 2. It is also contemplated that more than one drive unit 112 could be provided.

Similar to a stern-mounted outboard engine, the drive unit 112 can be trimmed up (out) or down (in) relative to the mounting bracket 116 about a trim axis 124 extending generally horizontally thereby changing the angle of the propeller shaft 146 with respect to the mounting bracket 116. The trim angle can be adjusted manually, hydraulically or by-wire, as is known in the art. The throttle and trim angle of the outboard engine 100 is controlled from the helm whichever actuation mechanism is used for adjusting the trim angle. Positioning an outboard engine 100 at or near the longitudinal center plane 32 of the boat 10 rather than at the stern 6 has an effect on the boat dynamics, as will be discussed in further detail below.

In a conventional stern-mounted application, the drive unit 112 would also be pivotable about a vertical steering axis for steering the boat. In contrast, in the illustrated embodiment of the pontoon boat 10, steering is accomplished by the rudders 34 and/or by the lateral thrusters 40 as mentioned above. As such, the drive unit 112 of the pontoon boat 10 is not pivotable for steering. It is however contemplated that the drive unit 112 of the center-mounted outboard engine 100 shown herein could be connected to the mounting bracket 116 so as to be pivotable about a vertical steering axis. For example, the drive unit 112 could be pivotable about the vertical steering axis by an angle 100° to port and 100° to starboard (i.e. a total angle of 200°), with respect to a longitudinal plane containing the vertical steering axis, so as to propel the pontoon boat 10 in a lateral direction.

Positioning the outboard engine 100 near the longitudinal center plane 32 of the pontoon boat 10 changes the effect of trim angle adjustment on the boat 10 compared to a boat 10 having a stern-mounted outboard engine as in the prior art. The propeller 120 applies a thrust on the boat 10 in a direction coaxial with the propeller shaft 146. When the drive unit 112 is trimmed in/out so that the propeller shaft 146 is not horizontal, the thrust applied to the boat 10 has a vertical (upward/downward) component. When the drive unit 112 is trimmed in, the propeller thrust has an upward component. When the drive unit is trimmed out, the propeller thrust has a downward component. As will be appreciated by one skilled in the art, trimming in and out a conventional, stern-mounted outboard engine has the effect of pushing the bow down and up, respectively. However, adjusting the trim angle of the drive unit 112 on the pontoon 10 has a different effect. More specifically, when the drive unit 112 is trimmed in, the main effect of the upward thrust from the propeller 120 is to lift the entire boat 10, including both of the bow end 5 and the stern end 6, upwards out of the water. Trimming in the drive unit 112 may also push the bow end 5 up slightly more than the stern end 6. Trimming out the drive unit 112 reduces the upward thrust from the propeller 120 and reduces the lifting associated therewith. This is due at least in part to the propeller thrust being applied much closer to the center of gravity of the boat 10 and the buoyancy of the pontoons 14 that extend both in front of and behind the propeller 120. These hydrodynamic effects could also vary with boat speed and based on whether or not the boat 10 is on plane.

With reference to FIGS. 1 and 2, the outboard engine 100 is mounted along the longitudinal centerline 26 such that the mounting bracket 114 is connected to the engine mount 50 at a position that is spaced from the longitudinal center plane 32 by a distance X. The distance X is determined based on the boat length L of the pontoon 14. The length L of a boat can, in general be defined in various ways as mentioned above. For a pontoon boat such as the boat 10, however, the length L is typically defined based on the length of the pontoons 14. The distance X can be up to one-fourth of the boat length L. The longer the length L, the farther rearward the outboard engine 100 will be positioned, i.e. the distance X is a greater fraction of the boat length L. For smaller pontoon boats 10, measuring up to 6 m (20 feet) in length, the outboard engine 100 may be positioned with the driveshaft 144 being up to 30 cm (one foot) behind the longitudinal center plane 32. For a 7 m (23-foot) pontoon boat 10, the outboard engine 100 could be positioned with the driveshaft 144 up to 60 cm (two feet) behind the longitudinal center plane 32. The outboard engine 100 is mounted such that the driveshaft 144 is spaced from the stern end 6 by a distance at least equal to one-fourth of the boat length L. It is also contemplated that the distance X could be defined with respect to a center of gravity of the boat 10, or the driveshaft 144, or the propeller shaft 146 instead of the mounting bracket 114.

The center of gravity (CG) of the boat 10 having the center-mounted outboard engine 10 described above is disposed further forwardly than that of a conventional boat of a comparable size which has a stern-mounted outboard engine. This positioning of the CG is also beneficial during transport of the boat 10 on a trailer having its front end attached to the rear of the transport vehicle, typically by a joint such as a ball and socket joint. The torque exerted on the joint depends on its distance from the CG of the boat being carried by the trailer. A center-mounted boat 10 exerts a smaller torque on the joint than a stern-mounted boat of a comparable dimension and weight since the CG of the center-mounted boat 10 is closer to the joint than the CG of the conventional stern-mounted boat. The joint used to connect the trailer to the transport vehicle could therefore be smaller, and would require less frequent replacement, for a center-mounted boat 10 than for a conventional stern-mounted boat.

The pontoon boat 10 shown herein, having the center mounted outboard engine 100, can provide an unobstructed view from the helm of the pontoon boat 10 of the area in the vicinity of the boat 10, especially the area behind the boat 10, since the rear portion of the boat 10 does not need to be blocked by a guardrail, wall or other obstacle typical in boats having stern-mounted outboard engines. The unobstructed view of the area in the vicinity of the boat is also advantageous when a water skier, wake-boarder, raft, and the like, is being towed behind the boat 10. In addition to the unobstructed view towards the rear, the pontoon boat 10 shown herein could also be configured to allow entry and exit of passengers and/or cargo from the stern end of the boat 10 leaving more space in the remaining areas of the deck for storage of cargo, seating of passengers, and the like.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A pontoon boat comprising:

a left pontoon and a right pontoon, the left and right pontoons extending longitudinally, a central axis of the left pontoon being parallel to a central axis of the right pontoon;

a longitudinal centerline disposed in a plane containing the central axes of the left and right pontoons, the longitudinal centerline being equidistant from each of the central axes of the left and right pontoons;

a deck being supported by the left and right pontoons;

a tunnel extending between the left and right pontoons below the deck;

a bow end being defined by at least one of the left pontoon, the right pontoon and the deck;

a stern end being defined by at least one of the left pontoon, the right pontoon and the deck;

a boat length being defined by a distance between the bow end and the stern end;

a longitudinal center plane of the boat being defined by a vertical plane normal to the longitudinal centerline and disposed longitudinally equidistant from the bow end and the stern end;

an opening being defined in the deck and communicating with the tunnel;

an outboard engine being mounted in the opening; and a hatch being disposed over the opening and the outboard engine, the outboard engine comprising:

a drive unit comprising:

a driveshaft;

a propeller shaft operatively connected to the driveshaft; and a propeller connected to the propeller shaft; and a mounting bracket connecting the drive unit to the deck, the outboard engine being disposed forward of the stern end by a distance at least equal to one-fourth of the boat length in the longitudinal direction, and the outboard engine being one of aligned with and rearward of the longitudinal center plane in the longitudinal direction.

2. The pontoon boat of claim 1, wherein:

the boat length is one of equal to and less than twenty feet; and the outboard engine is disposed at a position about the longitudinal center plane in the longitudinal direction.

3. The pontoon boat of claim 1, wherein:

the boat length is greater than twenty feet; and the outboard engine is disposed at a position at least equal to one foot behind the longitudinal center plane in the longitudinal direction.

4. The pontoon boat of claim 1, wherein the driveshaft is aligned with the longitudinal centerline in the lateral direction.

5. The pontoon boat of claim 1, further comprising a deflector mounted in the tunnel forward of the outboard engine.

6. The pontoon boat of claim 5, wherein the propeller is disposed lower than the deflector when the driveshaft is disposed in a vertical orientation.

7. The pontoon boat of claim 5, wherein the deflector is attached to the deck.

8. The pontoon boat of claim 6, wherein the mounting bracket is connected to the deflector.

9. The pontoon boat of claim 1, wherein the drive unit is pivotable with respect to the mounting bracket about a trim axis, the trim axis being horizontal and perpendicular to the longitudinal centerline.

10. The pontoon boat of claim 1, wherein the drive unit is fixed with respect to the mounting bracket about a vertical axis.

11. The pontoon boat of claim 1, further comprising at least one rudder connected to a rear portion of at least one of: the deck, the left pontoon and the right pontoon.

12. The pontoon boat of claim 11, wherein the rear portion is the rear end.

13. The pontoon boat of claim 11, wherein the at least one rudder comprises a left rudder and a right rudder.

14. The pontoon boat of claim 13, wherein the left rudder is attached to the left pontoon and the right rudder is attached to the right pontoon.

15. The pontoon boat of claim 1, further comprising at least one lateral thruster, wherein:

each of the at least one lateral thruster is supported by at least one of: the deck, the left pontoon and the right pontoon, and for each of the at least one lateral thruster, a central axis of the lateral thruster is generally horizontal and generally transverse to the longitudinal centerline.

16. The pontoon boat of claim 13, wherein the at least one lateral thruster comprises:

a left lateral thruster mounted to the left pontoon; and a right lateral thruster mounted to the right pontoon.

17. The pontoon boat of claim 14, wherein:

the left lateral thruster is connected to a forward portion of the left pontoon; and the right lateral thruster is connected to a forward portion of the right pontoon.

18. The pontoon boat of claim 1, wherein:

the bow end is defined by the left pontoon and the right pontoon;

the stern end is defined by the left pontoon and the right pontoon; and the boat length defined by the distance between the bow end and the stern end is defined by the left pontoon and the right pontoon.

* * * * *